US009103158B2

(12) United States Patent
Martinez

(10) Patent No.: US 9,103,158 B2
(45) Date of Patent: Aug. 11, 2015

(54) TASSEL FOR BLIND CORDS

(71) Applicant: FUSTA BLINDS, S.L., Sollana (ES)

(72) Inventor: Juan José Borras Martinez, Valencia (ES)

( * ) Notice: Subject to any disclaimer, the term of this patent is extended or adjusted under 35 U.S.C. 154(b) by 45 days.

(21) Appl. No.: 13/900,509

(22) Filed: May 22, 2013

(65) Prior Publication Data

US 2013/0312223 A1 Nov. 28, 2013

(30) Foreign Application Priority Data

May 23, 2012 (ES) ..... 201230558 U

(51) Int. Cl.
*E06B 9/326* (2006.01)

(52) U.S. Cl.
CPC ..... *E06B 9/326* (2013.01); *E06B 2009/3265* (2013.01); *Y10T 16/4724* (2015.01)

(58) Field of Classification Search
CPC ..... E06B 9/326
USPC ..... 24/115 F
See application file for complete search history.

(56) References Cited

U.S. PATENT DOCUMENTS 7,587,794 B2 * 9/2009 Lin ..... 24/115 F
2008/0196213 A1 8/2008 Lin

* cited by examiner

*Primary Examiner* — Jack W Lavinder
(74) *Attorney, Agent, or Firm* — John Alumit

(57) ABSTRACT

A tassel for blind cords comprising at least two independent parts associated to the ends of the operating cords of blinds and some means to retain the these separate pieces in an assembled position thereby forming a tassel to operate blind cords, which also split apart when force is applied to the cords associated with the parts. The invention consists of means to retain the independent parts that form the tassel, is made of a retention elastic piece that embraces the outside surface of the independent parts and tends to keep them grouped together in an assembled position.

1 Claim, 3 Drawing Sheets

TASSEL FOR BLIND CORDS

CROSS-REFERENCE TO RELATED APPLICATION

This present application claims the benefit of Spanish Utility Model Application No. ES201230558U filed with the Spanish Patent and Trademark Office on May 23, 2012. The earliest priority date claimed is May 23, 2012.

FEDERALLY SPONSORED RESEARCH

Not Applicable

SEQUENCE LISTING OR PROGRAM

Not Applicable

BACKGROUND

The following invention relates to a tassel for blind cords, of the type that has a minimum of two independent parts linked to the end of two cords to operate blinds, and some means to retain the mentioned independent parts in an assembled position, thereby making a tassel to operate the blinds. The mentioned means separate the parts when a force is applied between the cords associated between them, which could be, by extension, cables, cords, chains, tapes or any other equivalent element, as this does not affect the essence of the invention.

This invention is applicable in the field of curtain production, especially in regards to venetian blinds and roman shades.

Certain blinds, such as venetian blinds and roman shades, have several operating cords that should be moved simultaneously to keep the bottom of the blinds in a horizontal position during the raising or lowering of the blinds. To make the simultaneous movement of the cords easier, the ends are usually passed through a hole in a tassel, fixing the cord ends between each other with a knot. This knot means that the ends of the cords form a closed and resistant loop, which could be especially dangerous for young children as it causes a risk of suffocation when children play with the blind cords.

In utility model ES 1073373 U, which belongs to the applicant of the present invention, a tassel is taught for blind cords that allows for splitting when applying force, thereby avoiding the risk of suffocation.

The solution proposed in ES 1073373U consists of using a tassel made of two independent parts which forms other perimeter portions of the tassel; having some grooves in the confronted faces in order to achieve a correct centering in the assembled position; and retained by magnets in the assembled position; whereby the parts that makes up the tassel separate when there is a force applied to the operating cords that is strong enough to defeat the magnetic attraction. This tassel, when fulfilling the desired goal, is not cost-efficient because the magnetic resource make the cost of production very expensive.

SUMMARY

The present invention relates to tassels for cords comprising at least two independent parts associated at the end of blind operating cords having a device that retains the mentioned independent parts in assembled position. This forms a complete operating tassel for the cords, whereby the device splits when a force is applied between the associated cords, thereby allowing production of the prior art without the use of magnets in order to reduce production cost.

In accordance with the invention, the retaining device of the independent parts which makes the tassel, is made of an elastic retention piece that embraces on the outside in order to keep the independent parts in a group when in an assembled position.

It should be noted that this elastic retention piece can have a ring shape, closed or open, and made with an elastic material. When embracing the independent parts making up the tassel, the elastic retention piece keeps the independent parts together in an assembled position; when a force is applied to the loop made by the ends of the associated cords, the independent parts separate side ways, deforming the retention elastic piece and releasing the independent parts.

According to the invention, the independent parts have a groove on the outside that has a channel shape around the tassel in the assembled position, onto which the retention elastic piece fits.

The mentioned retention elastic piece has a ring shape, open or closed, mainly with a general configuration of a "C" shape. Preferably this retention elastic piece is made of plastic material with the goal of making the cost of production cheaper.

According to the invention, the retention elastic piece and at least one of the independent parts that forms the tassel, have a complementary appendix and groove facing each other to fit in. This establishes the position and orientation of the elastic piece when the tassel is assembled.

This design means that the side opening of the retention elastic piece facing a contact surface of the independent parts of the tassel, allows the parts to separate easily when overcoming the resistance of the elastic piece by a force applied on the loop formed by the ends of the cords associated with the tassel parts.

DRAWINGS

DESCRIPTION

Figure 1:
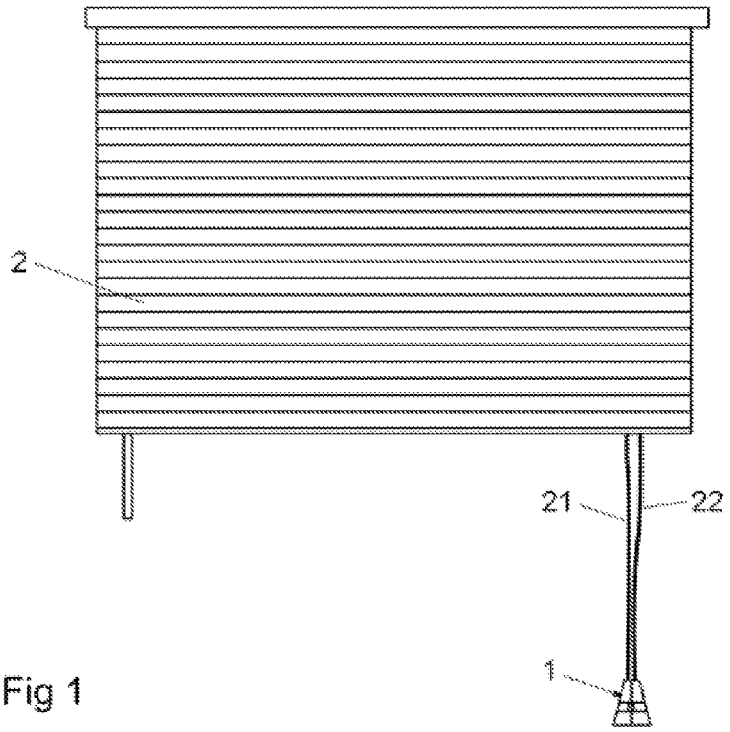
FIG. 1 shows an elevated view of the inventive tassel.
Figure 2:
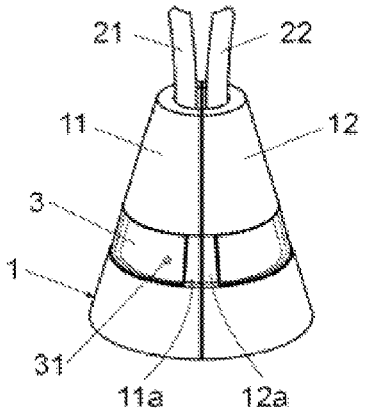
FIG. 2 shows an expanded perspective view of the inventive tassel in use.
Figure 3:
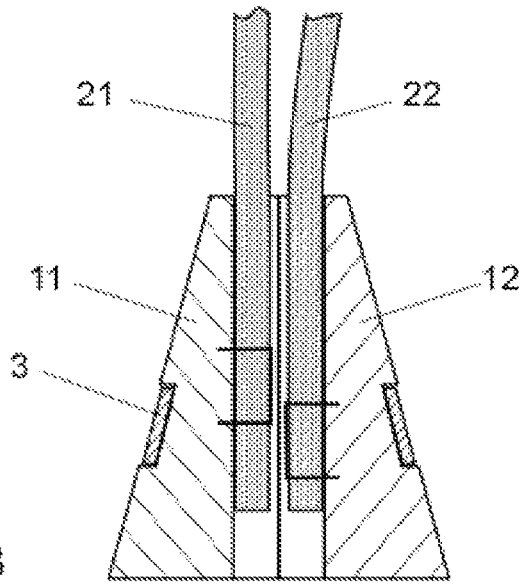
FIG. 3 shows an elevated view of the tassel in FIG. 2, divided in a vertical plan in a use position.
Figure 4:
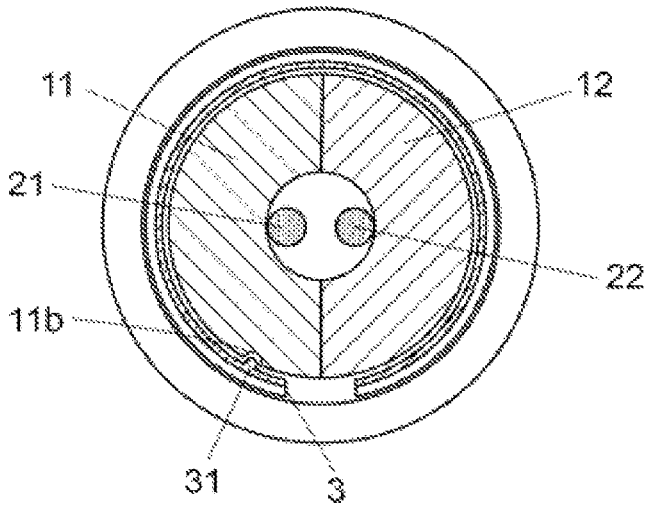
FIG. 4 shows a view from above the tassel in FIG. 2, divided in a horizontal plan.

Preferred Embodiment. In the preferred embodiment shown in FIG. 1 a tassel (1) of present invention is fixed to operating cord ends (21,22) of a venetian type blind (2). FIGS. 2, 3 and 4 show the tassel (1) in greater detail constituted by two parts (11, 12), like a truncated cone section fixed to the ends of the respective cords (21,22) of the blind. These cords (21, 22) can be fixed to independent parts (11, 12) by sticking, by stapling as shown in FIG. 3, or by any other means, as this does not affect the essence of the present invention. The mentioned parts (11, 12) externally have independent separate recesses (11*a*, 12*a*) which, in the assembled position of the tassel, comprise a perimeter channel for mounting an elastic retention piece (3). In the example shown, the elastic retention piece consists of a plastic piece with a "C" shape and with a taper similar to that of one on independent parts (11, 12).

As seen in FIGS. 2 and 3, this elastic piece (3) holds the two independent parts (11, 12) which forms the tassel, provided that this elastic retention part (3) deforms elastically to release the independent parts (11, 12) when force is applied between the attached cords (21, 22).

Figure 5:
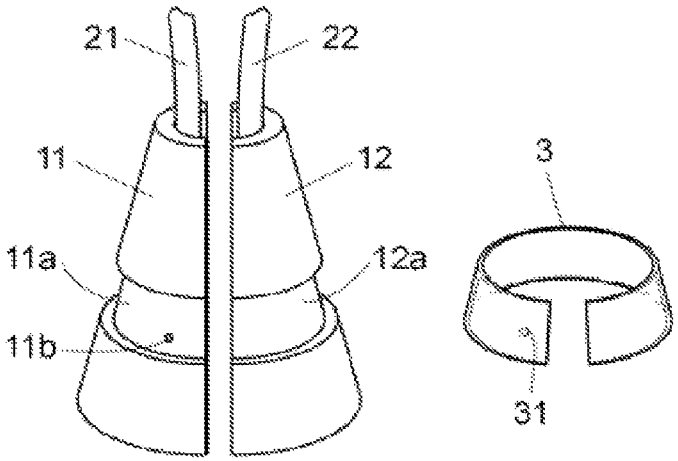
FIG. 5 shows a perspective view of the tassel in the previous figures with the two independent parts, associated to the cord edges, separated and with a dismantled elastic retention piece.

As can be seen in FIGS. 4 and 5, the retaining elastic piece (3) and one of the independent pieces (11) that forms the tassel, shows one appendix on their outer surface (31) and a complementarily coupling groove (11*b*), which establish a certain position and orientation of the elastic piece (3) in the assembled position of the tassel. In this case, the coupling of the appendix (31) and the groove (11*b*) requires that the opening side of the elastic piece (3) face the flat contact face of the independent parts (11, 12), making the splitting and releasing of the parts (11, 12) easier when pressure is applied to the inside of the loop formed by the cords (21, 22) attached to the mentioned parts (11, 12).

It is worth mentioning that the number of independent parts making up the tassel depends on the number of blind operating cords, and that the shape of these independent parts can differ, as long as the groove designed to form a perimeter channel for mounting the elastic retaining piece around them is present.

Figure 6:
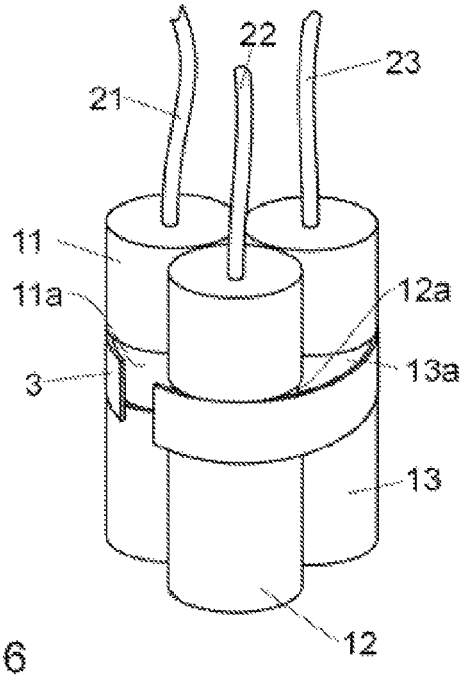
FIG. 6 shows an alternative embodiment of the tassel in which the independent parts have a cylindrical shape joined by an elastic retention piece as an such as an open ring.

In the alternative embodiment shown in FIG. 6, the tassel is constituted by three parts (11, 12, 13), in this case cylindrical, associated to the respective cords (21, 22, 23), with corresponding grooves (11*a*, 12*a* , 13*a*) for mounting the corresponding retention elastic part (3).

Once described, the nature of the invention as well as an example of an embodiment, it should be understood that the materials, shape, size and arrangement of the elements described can be modified, provided that this does not alter the essential features of the invention as claimed below.

The following are claimed:

1. A tassel for blind cords comprising at least two independent parts, and a retention elastic piece, said at least two independent parts comprising independent separate recesses, which, in the assembled position of the tassel, comprise a perimeter channel for mounting the retention elastic piece, wherein the retention elastic piece and at least one of the at least two independent parts form a coupling, comprised of an appendix and a complimentary groove, said appendix disposed on the outer surface of one of the retention elastic piece or independent parts and the complimentary groove disposed on the other of the retention elastic piece or independent parts, and wherein said coupling of the appendix and complimentary groove establishes a certain position and orientation of the retention elastic piece in the assembled position with regard to the tassel.

* * * * *